United States Patent [19]

Bond et al.

[11] Patent Number: 4,602,777

[45] Date of Patent: Jul. 29, 1986

[54] SHEET FEEDING APPARATUS

[75] Inventors: Kevin J. Bond; David E. Wake, both of Hampshire, England

[73] Assignee: De La Rue Systems Limited, Portsmouth, England

[21] Appl. No.: 639,206

[22] Filed: Aug. 9, 1984

[30] Foreign Application Priority Data

Aug. 10, 1983 [GB] United Kingdom ..... 8321519

[51] Int. Cl.[4] ..... B65H 5/26; B65G 37/00

[52] U.S. Cl. ..... 271/9; 271/303; 198/357; 198/452

[58] Field of Search ..... 271/303, 9, 279, 264, 271/272, 273, 274, 275, 277, 902; 198/357, 452, 368

[56] References Cited

U.S. PATENT DOCUMENTS

| | | | |
|---|---|---|---|
| 3,963,339 | 6/1976 | Taylor et al. | 271/9 |
| 4,004,795 | 1/1977 | Agnew et al. | 271/902 |
| 4,157,822 | 6/1979 | Miller | 271/9 |
| 4,320,854 | 3/1982 | Hirose | 221/12 |
| 4,482,057 | 11/1984 | Shawen et al. | 271/303 |

FOREIGN PATENT DOCUMENTS 1113942 9/1961 Fed. Rep. of Germany .

2101568A 1/1983 United Kingdom .

*Primary Examiner*—Bruce H. Stoner, Jr.
*Assistant Examiner*—Matthew C. Graham
*Attorney, Agent, or Firm*—Cushman, Darby & Cushman

[57] ABSTRACT

This relates to sheet feeding apparatus of the kind in which sheets following separate first and second belt transport paths are fed into a common belt transport path. At the junction of portions of the paths of belts 5 and 9 which define portions of the first and second belt transport paths, a sheet guide 8 is freely mounted for pivotal movement about the shaft of a roller 20, the guide 8 having surfaces tapering to a leading end which extends towards the meeting point of the belts 5 and 9. One of these surfaces assists in guiding notes from the first path into the third common belt transport path, defined by the belts 5 and 9 upstream of their meeting point and the other of the guide surfaces guides notes arriving from the second belt transport path into the common path. Because the guide is freely mounted, it can be deflected by the sheets themselves and as they do not arrive at the junction simultaneously, adequate clearance is necessary on only one side of the guide at any one time and its leading end can extend further into the junction.

4 Claims, 3 Drawing Figures

SHEET FEEDING APPARATUS

This invention relates to the feeding of sheets along a sheet transport system, and in particular a system in which the sheet is fed within a belt track and passed from one belt track to another in order to change direction of travel. Such belt transport systems are much less expensive than systems employing, for example, gear-driven vacuum drums at each point. However, problems can arise where sheets guided by belts along two different channels pass into a common channel; at such a junction if the notes are not properly guided, the leading edge of a note travelling at high speed along one of the input channels may be damaged by striking a belt at an angle to the actual path of the note.

The present invention consists in sheet feeding apparatus including a belt transport system defining first, second and third belt transport paths and in which sheets following the first and second belt transport paths are fed into the common third belt transport path, the apparatus including at the junction of the said three paths a sheet guide having first and second surfaces which co-operate with belt portions of the said system to define the said first and second paths, adjacent to the junction, the said surfaces tapering to a leading end of the guide which extends towards the common belt transport path, the apparatus being characterized in that the guide is freely mounted for pivotal movement about an axis such that a sheet passing along the first or the second belt transport path deflects the leading end of the guide, unless the guide is already so deflected, to increase the size of the gap constituting the said path while reducing the space on the other side of the guide constituting the other of the first and second paths.

In the preferred arrangement, the said surfaces of the sheet guide, which taper to its leading end, are concave and the guide is shaped in such a manner that it can be clipped on to a shaft whose axis is the axis of pivotal movement of the guide.

A fixed guide or diverter, mounted at the junction of the three paths, would have assisted to some extent in carrying the note around the angle but it does not reduce the damage to the edge of the note sufficiently. Because the guide or diverter in the present invention is freely mounted on its shaft, its leading end can be advanced further into the gap between the two converging paths. This is because the passage of sheets along the two paths will be timed so that when a sheet from the first belt transport path is entering the common path, no sheet from the second belt transport path is entering the common path, and vice versa. Consequently, a note entering the common belt path from either of the converging paths can deflect the diverter towards the other belt path to increase the gap on its side at the expense of the gap on the other side of the diverter. Thus, supposing it is decided to allow for the passage of three superimposed sheets from either of the converging paths into the common path. With a fixed diverter, the total of the gaps on the opposite sides of the diverter would have to be such as to accommodate six sheet thicknesses. However, with the freely mounted guide of the present invention, it is necessary to ensure only that when the guide is pivoted to its extreme position on either side, a gap sufficient for three sheet thicknesses is left on the other side.

In order that the invention may be better understood, an example of apparatus embodying the invention will now be described with reference to the accompanying drawings, in which.

Figure 1:
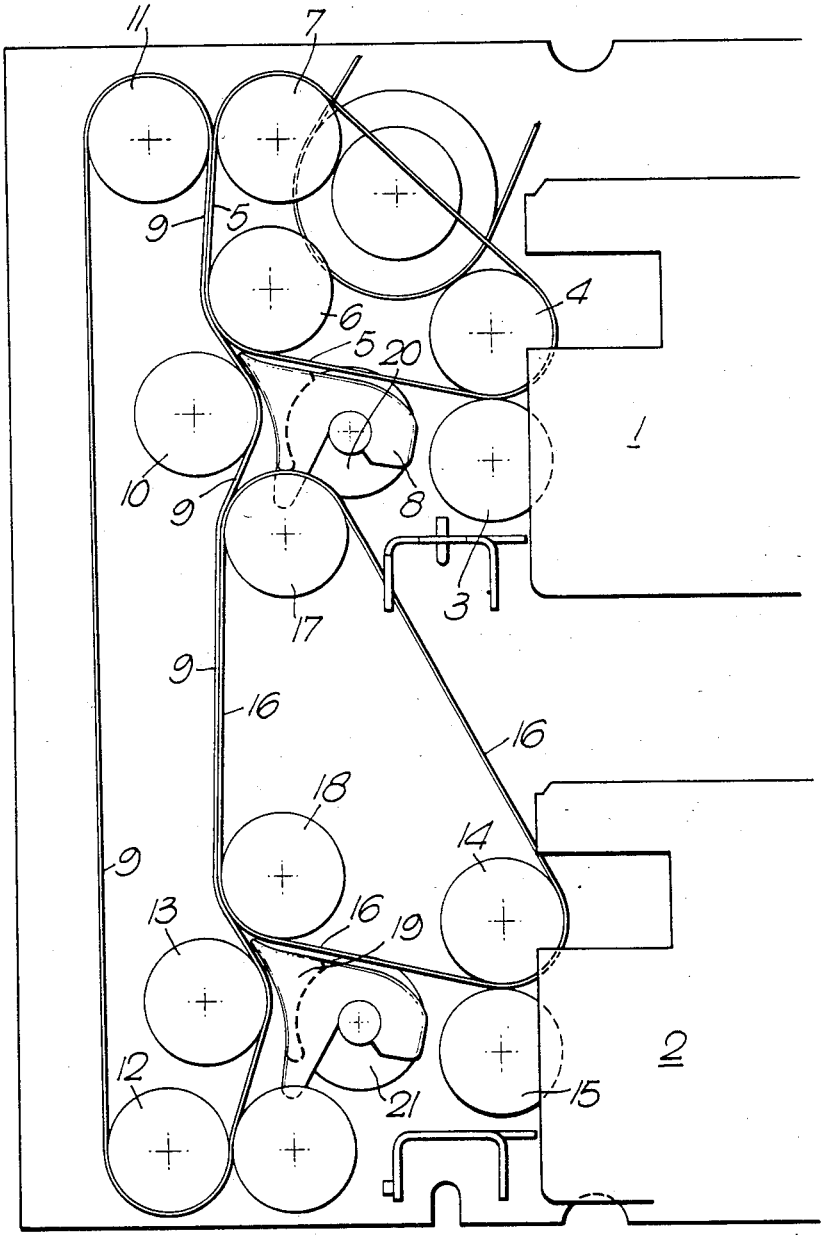
FIG. 1 shows diagrammatically a belt transport system embodying the invention.

In this example, the invention is applied to a banknote dispensing machine of the kind able to dispense several denominations of banknotes. Each denomination is held in a separate cassette and when the requirements of an operator (customer or bank teller) are known, the notes are dispensed from the appropriate cassette and are fed into a common path along which they travel towards the delivery outlet of the machine.

In the drawing, the front ends 1 and 2 of two cassettes are shown. Notes are fed by a known sheet feeding means (not shown) from the cassette 1 and pass between rollers 3 and 4. A continuous belt 5 passes round the roller 4 and around rollers 6 and 7. The note passing between rollers 3 and 4 enters the gap between the belt 5 and a guide or diverter 8. As it leaves this gap, the note passes between the belt 5 and a belt 9 of a further belt system, in which the belt 9 passes around rollers 10, 11, 12 and 13. The note leaves the belts 5 and 9 where these belts diverge as they pass around the rollers 7 and 11 respectively and is forwarded by another note transport system, not shown.

In a similar way, notes delivered from the second cassette 2 pass between rollers 14 and 15 before entering the gap between a belt 16, passing around rollers 14, 17 and 18, and a sheet guide or diverter 19. As before, on leaving the space between the guide 19 and the belt 16, the note passes between belts 9 and 16 and is advanced by these belts towards the guide 8. Where the belts 9 and 16 diverge (the belt 16 passing round the roller 17 and the belt 9 around the roller 10), the note from the second cassette is fed into the space between the guide 8 and the roller 10. On leaving this space, this note passes between the belts 5 and 9 and thus follows the path of the note from the first cassette.

Each sheet guide is formed in a manner enabling it to be clipped into place over the shaft on which it is mounted. Thus, the guide 8 is clipped over the shaft of a roller 20 and the guide 19 is clipped over the shaft of a roller 21. However, the size of the central recess in each guide enables it to be moved freely on its shaft. For this reason, as the note from the first cassette reaches guide 8 it will push the leading edge of this guide towards the belt 9 and roller 10, thus enlarging the gap between the concave surface of the guide and the belt 5. In a similar way, the note from the second cassette will displace the guide 19 to increase the gap between the guide and the belt 16. However, when this second note has been advanced by the belts 9 and 16 up to the guide 8, it will push the guide 8 in a direction opposite to that in which the guide was urged by the first note, thereby enlarging the gap between the guide 8 and the belt 9.

As stated above, because the total of the two gaps on either side of the guide can now be less, the leading edge of the guide can project further into the space between the converging belts and for this reason notes passing along either of the first and second belt transport systems can be guided further towards the common belt transport. In this way, a note can be passed from one belt system to another, changing the direction of travel, without significant damage to the edge of the note. Means are of course provided for ensuring that notes from the cassettes 1 and 2 do not arrive together at the junctions.

It will be understood that the guide 19 also serves to guide notes from a third cassette, under the cassette 2, into the belt transport defined by the belts 9 and 16.

Figure 2:
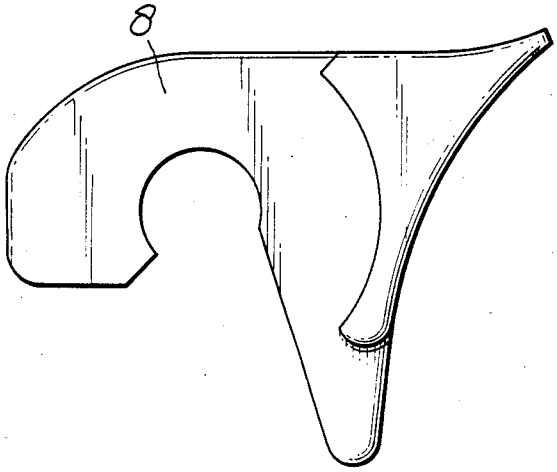
FIG. 2 and 3 are respectively a side elevation and an end view of the guide or diverter.
Figure 3:
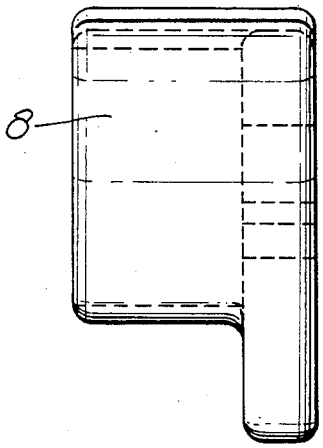

The shape of the guide is shown in the side elevation and end view of FIGS. 2 and 3. The guide can be made from glass-filled 30% nylon type 6.

Thus, we have described a belt transport system in which a diverter or guide 8 is arranged at the junction of three belt transport paths. The first is defined by the rollers 3 and 4, the belt 5 and the guide 8; the second is defined by belts 16 and 9, rollers 17 and 10 and the guide 8; and the common third belt transport path is defined by belts 5 and 9, with rollers 6, 7 and 11. The opposite concave surfaces of the guide 8 co-operate with portions of the belts 5 and 9 to define portions of the first and second paths, adjacent to the junction and these surfaces taper to a leading end which extends towards the meeting point of the belts 5 and 9. Banknotes fed from the cassettes 1 and 2 are timed so that they will not arrive at the junction together and are therefore forwarded in succession from the rollers 7 and to the next portion of the note transport system.

We claim:

1. Sheet fading apparatus including a belt transport system defining first and second belt transport paths each leading to a junction with a common third belt transport path whereby sheets following the first and second belt transport paths are fed into the common third belt transport path, the apparatus further including:

a sheet guide located at the said junction of the three paths and having first and second surfaces tapering to a leading end of the guide which extends towards the common third belt transport path;

the belt transport system including belt portions which cooperate with the first and second guide surfaces to define the said first and second paths adjacent to the junction;

the sheet guide being freely mounted for pivotal movement about an axis allowing the leading end of the guide to be deflected by the passage of the sheet along one of the first and second belt transport paths towards the common third belt transport path, the deflection increasing the size of a gap constituting the said one of the first and second belt transport paths by reducing a gap on the other side of the guide constituting the other of the first and second belt transport paths.

2. Sheet feeding apparatus as claimed in claim 1 in which the first and second surfaces of the sheet guide are concave.

3. Sheet feeding apparatus as claimed in claim 1 in which each sheet guide is formed to clip over a shaft about which the guide is freely pivotable.

4. Cash dispensing apparatus comprising first and second note cassettes, note feeding apparatus for feeding notes from the first and second belt transport paths into a common third belt transport path at a junction; and timing means controlling the dispensing of notes from the cassettes to ensure that notes from the first and second cassettes do not arrive at said junction simultaneously, the note feeding apparatus comprising a note guide located at the said junction of the three paths and having first and second surfaces tapering to a leading end of the guide which extends towards the common third belt transport path; the belt transport system including belt portions which cooperate with with the first and second paths adjacent to the junction; the note guide being freely mounted for pivotal movement about an axis allowing the leading end of the guide to be deflected by the passage of the note along one of the first and second belt transport paths towards the common third belt transport path, the deflection increasing the size of a gap constituting the said one of the first and second belt transport paths by reducing a gap on the other side of the guide constituting the other of the first and second belt transport paths.

* * * * *